US010080419B2

(12) United States Patent
Wolffe

(10) Patent No.: US 10,080,419 B2
(45) Date of Patent: Sep. 25, 2018

(54) BACKPACK

(71) Applicant: David Wolffe, London (GB)

(72) Inventor: David Wolffe, London (GB)

( * ) Notice: Subject to any disclaimer, the term of this patent is extended or adjusted under 35 U.S.C. 154(b) by 155 days.

(21) Appl. No.: 14/773,545

(22) PCT Filed: Mar. 7, 2014

(86) PCT No.: PCT/GB2014/050682
§ 371 (c)(1),
(2) Date: Sep. 8, 2015

(87) PCT Pub. No.: WO2014/135894
PCT Pub. Date: Sep. 12, 2014

(65) Prior Publication Data

US 2016/0022016 A1 Jan. 28, 2016

(30) Foreign Application Priority Data

Mar. 8, 2013 (GB) ..... 1304254.4
Feb. 17, 2014 (GB) ..... 1402768.4

(51) Int. Cl.
*A45F 3/04* (2006.01)
*A45F 3/08* (2006.01)

(52) U.S. Cl.
CPC ..... *A45F 3/04* (2013.01); *A45F 3/08* (2013.01); *A45F 2200/00* (2013.01)

(58) Field of Classification Search
CPC ..... A45F 3/04–3/08; A45F 2200/00
USPC ..... 224/627–359, 196, 197, 162, 262, 201, 224/259–261, 263
See application file for complete search history.

(56) References Cited

U.S. PATENT DOCUMENTS 4,858,797 A * 8/1989 Rabska ..... A62C 33/00 224/162
5,337,934 A 8/1994 Johnson et al.
(Continued)

FOREIGN PATENT DOCUMENTS

DE 19605679 A1 8/1997
DE 19129956 A1 1/1999
(Continued)

OTHER PUBLICATIONS

International Preliminary Report on Patentability dated Sep. 8, 2015 issued in the corresponding PCT/GB2014/050682 (7 sheets).
(Continued)

*Primary Examiner* — Scott McNurlen
(74) *Attorney, Agent, or Firm* — Millen, White, Zelano & Branigan, P.C.; William Nixon

(57) ABSTRACT

An assembly for adjusting the position of a load for a backpack has a supporting member (3), an actuating means (35), and a plurality of elongate flexible movable members (7). Each of the elongate flexible movable members are attached to a load carrying portion (1) at one end, and attached to the actuating means at the second end. The load carrying portion is movable between: a retracted position, in which the load carrying portion abuts the supporting member, when the actuating means is moved into a first position; and an extended position, in which a user can freely move the load carrying portion relative to the supporting member, when the actuating means is moved into a second position.

18 Claims, 18 Drawing Sheets

(56) References Cited

U.S. PATENT DOCUMENTS

| | | | | |
|---|---|---|---|---|
| 5,934,533 | A * | 8/1999 | Callanan | A45F 3/04 224/250 |
| 7,232,048 | B2 * | 6/2007 | Le Gal | A45F 3/04 224/201 |
| 8,887,976 | B2 * | 11/2014 | Vierthaler | A45F 3/04 224/197 |
| 9,282,806 | B2 * | 3/2016 | Vierthaler | A45F 3/10 |
| 2006/0138188 | A1 * | 6/2006 | Kramer | A45F 3/08 224/581 |
| 2008/0302839 | A1 * | 12/2008 | Murdoch | A45F 3/04 224/153 |
| 2012/0118925 | A1 * | 5/2012 | Burton | A45F 3/04 224/259 |
| 2014/0203057 | A1 * | 7/2014 | Goryl | A41D 13/0012 224/576 |

FOREIGN PATENT DOCUMENTS

| | | | |
|---|---|---|---|
| WO | 9400036 | A1 | 1/1994 |
| WO | 0197650 | A1 | 12/2001 |
| WO | 02082945 | A1 | 10/2002 |

OTHER PUBLICATIONS

International Search Report dated Jun. 24, 2014 issued in corresponding PCT/GB2014/050682 application (pp. 1-3).
English Abstract of DE 19729956 A1 published Jan. 14, 1999.

* cited by examiner

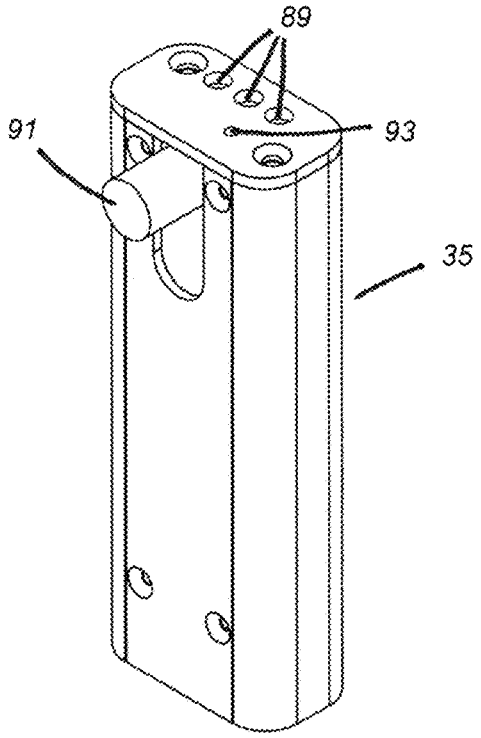
FIG. 10
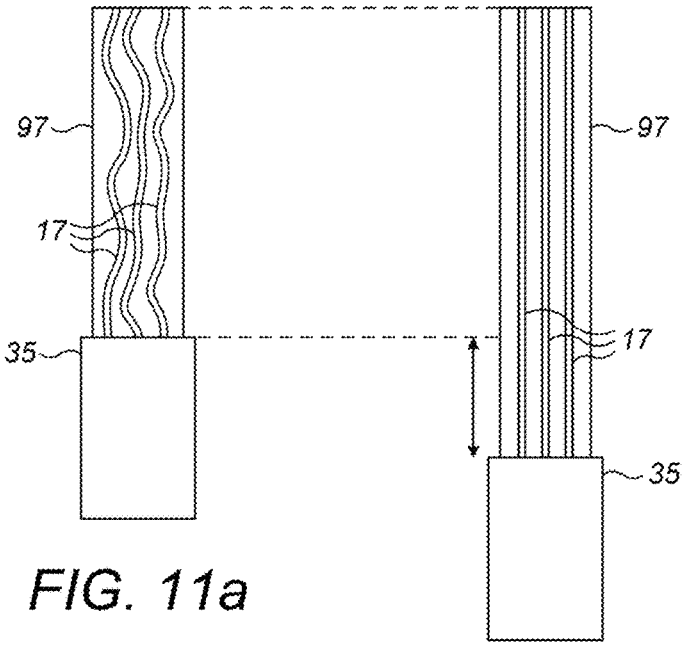
FIG. 11a
FIG. 11b

BACKPACK

TECHNICAL FIELD OF INVENTION

The present invention relates to a backpack, and in particular to a backpack with a movable load carrying portion

BACKGROUND TO THE INVENTION

Backpacks are in common use for carrying items in a convenient and comfortable fashion whilst leaving a user's hands free. Once a backpack is strapped to the back of a user, it is however difficult to access its contents. Typically, it is necessary for a user to unstrap the backpack to access the contents. This is inconvenient, in particular if the user is handling a large object such as a suitcase, if the user is minding a child, or if there is no clean or stable surface on which to rest the backpack whilst accessing contents. It is also inconvenient if speed of access is important, for example for photographers or military users.

Additionally, backpacks generally take up large amounts of space and thus make it difficult for users to sit down (and, sometimes, to move about or stand) in conditions where space is at a premium, such as on a train or a bus during rush hour, or on a skilift. In such a situation, it would be advantageous if a user could manually maneuver the backpack into a convenient position to make more efficient use of available space.

Further, the repeated act of unstrapping the backpack, unloading and reloading, and strapping on the backpack may precipitate back problems for a user, in particular if heavy loads are being carried in the backpack.

Several prior proposals suggest mechanisms for moving a backpack from a first position on the user's back to a second position at the user's front, generally using sliding arrangements. Such mechanisms often require a rigid hinge, or necessitate that the user has a hip belt attached at all times, both of which are inconvenient. Further, such mechanisms often involve a change in orientation of the backpack, which can potentially damage delicate loads.

DE 197 29 956 relates to a backpack which has a luggage pack and a back portion. The back portion is worn by a user on his or her back in a conventional fashion. The luggage pack is attached to the back portion by way of a line in a closed loop configuration and a pulley mechanism. By pulling in either one or the other direction on the line, a user can move the luggage pack either into a raised and locked position where the luggage pack is secured to the back portion, or into a lowered position where the luggage pack is suspended from the line at the side of the user.

This arrangement is disadvantageous because the luggage pack is not freely movable in the lowered position. Further, the arrangement is inconvenient as the line is positioned at the user's hip. This makes it difficult or impossible for a user to manipulate the line with both hands simultaneously, which is disadvantageous if for example the luggage pack is heavy. Also, it is difficult for a user to sit in a crowded space such as a bus or train with the pack at their hip. Finally, the means of moving the pack between the two positions is inconvenient, requiring the user to pull the pack down as well as pulling it up, and mechanically complex.

As a separate matter, there have been proposals to provide heavy backpacks with a luggage pack and a back portion in which the vertical alignment of the luggage pack can be adjusted through a small range to increase the comfort of the user whilst walking long distances.

The present invention seeks to address at least some of these problems.

SUMMARY OF THE INVENTION

In accordance with a first aspect of the invention, there is provided an assembly comprising: a supporting means; an actuating means; and a plurality of elongate flexible members in movable engagement with the supporting member, wherein each of the members is attached at a first end to a load carrying portion, and each of the members is attached at a second end to the actuating means, and wherein the elongate flexible members are operable to move the load carrying portion between: a retracted position, in which the load carrying portion abuts the supporting means, when the actuating means is moved into a first position; and an extended position, in which a user can freely maneuver the load carrying portion relative to the supporting member, when the actuating means is moved into a second position.

The assembly allows a user to move a load carrying portion, which may potentially be heavy or inconvenient to reach when in the retracted position, by manipulating the actuating means rather than directly manipulating the load carrying portion or the elongate flexible members. The actuating means can be positioned and/or adapted to enable convenient and/or easy manipulation of the load carrying portion by the user, thus facilitating movement of, and access to, the load carrying portion.

The supporting means may comprise a supporting frame, which may be formed from a single frame element or may comprise a plurality of frame elements which are mutually attached by a suitable means. The supporting frame may be provided with one or more supporting elements or braces. Each of the frame elements and supporting elements may have any suitable geometric shape. The frame elements and/or supporting elements may be formed so as to, for example, increase rigidity and stability of the supporting frame, provide an efficient load transfer means, spreading a load across a user's back or provide additional support for a user's back.

In one embodiment, the supporting frame comprises a substantially planar molded frame element, whose surface is shaped so that, when the assembly is worn by a user, the frame element substantially conforms to the shape of the back of the user. This increases user comfort when the supporting frame is worn, as well as providing additional support for a user's back. The frame element may additionally be adapted so as to increase air flow to the user's back to further increase user comfort. In another embodiment, the supporting frame comprises the same molded frame element as above, to which is attached a plurality of tubular supporting elements for guiding at least one of the plurality of elongate flexible members.

In another embodiment, the supporting frame comprises a single frame element with a curved central portion and two substantially parallel end portions. In an alternative embodiment, the supporting frame additionally comprises a curved supporting element which is attached to the free ends of the frame element.

Each of the frame elements and supporting elements may have any suitable cross section, including but not limited to planar, circular, semi-circular, ellipsoid or polygonal. The cross section may be fixed or may vary along the length of the elements. The frame elements and supporting elements may have identical cross sections, or they may have different cross sections. Each of the frame elements and/or supporting elements of the supporting frame may be hollow for at least a portion of their lengths. In one embodiment, the supporting frame comprises a frame element and a plurality of supporting elements, wherein each of the supporting elements has a fixed tubular cross section. In another embodiment, the supporting frame comprises a frame element with a fixed tubular cross section. In an alternative embodiment, the supporting frame may be made entirely of tubular members.

The frame elements and/or supporting elements may in one embodiment be adapted to allow at least one of the elongate flexible members to pass therethrough along at least a portion of its length.

The supporting frame may be formed so as to minimise friction and/or unwanted contact between the supporting frame and the at least one elongate flexible member. In one embodiment, the supporting frame may be formed to maximise the radius of curvature of each of the frame elements and supporting elements, or portions of each of the frame elements and supporting elements, through which the at least one elongate flexible member passes. In another embodiment, the supporting frame is formed so as to guide the at least one elongate flexible member substantially away from at least one other portion of the supporting frame.

The supporting frame may be formed of any suitable material, including but not limited to plastics materials, fibrous materials or metal. Each element of the supporting frame may be formed of a plurality of materials or it may be formed of a single material. Each of the frame elements and/or supporting elements may be formed of the same material or may alternatively be formed of different materials. In one embodiment, the supporting frame may comprise a frame element and a supporting element which are made of a semi-rigid flexible plastics material.

The surface of the supporting frame may be provided with a plurality of apertures. In an embodiment, the supporting frame comprises a frame element and a plurality of supporting elements, each of said supporting elements have at least one aperture. The apertures may have any suitable geometric shape, including but not limited to circular, ellipsoid or polygonal. In one embodiment, the apertures are substantially circular with a diameter larger than the maximum diameter of the elongate flexible members for enabling the elongate flexible members to pass therethrough. In an alternative embodiment, the apertures are formed so as to minimise friction between the edges of the apertures and any elongate flexible member passing therethrough.

The apertures may be arranged in any suitable configuration and orientation on the surface of the supporting frame. In one embodiment, the apertures are arranged in a configuration which is substantially symmetrical around the central vertical axis of the supporting frame. In another embodiment, the apertures are arranged in a configuration which is substantially identical to a configuration of anchors on the luggage carrying portion.

The supporting frame may be provided with one or more top apertures. The top aperture may have substantially the same shape and dimensions as the remaining apertures, or it may have a different shape and/or different dimensions than the remaining apertures. In one embodiment, the top aperture has an identical shape and larger dimensions than the other apertures. In an alternative embodiment, the top aperture is dimensioned to allow all of the elongate flexible members to pass therethrough simultaneously.

Each of the apertures may be provided with an engagement means on or adjacent to the edges thereof. The engagement means may have any suitable shape or form for engaging with a corresponding engagement means provided on the load carrying portion. The engagement means may be provided with features or formations for indicating, to the user, a proper engagement between the engagement means and corresponding anchor engagement means provided on the load carrying portion.

Each of the apertures may be provided with friction reducing means on or adjacent to the edges thereof. The friction reducing means may take any suitable shape or form. In one embodiment, the friction reducing means comprises a coating of friction reducing material on or adjacent to the edge of at least one of the apertures. In an alternative embodiment, the friction reducing means comprises a formation or feature provided on or adjacent to the edge of an aperture, said formation or feature being provided with friction reducing elements, such as bearings.

The assembly may be provided with a locking means for releasably retaining at least one of the elongate flexible members. This enables a user to move the load carrying means into at least one of the upper or lower positions and lock it in place by releasably retaining the elongate flexible members in place. The locking means may comprise a frictional retention means which releasably retains the elongate flexible members. Alternatively, the locking means may comprise a clasp or clamp. The locking means may comprise both of a frictional retention means and a clasp or clamp. In one embodiment, the locking means may comprise a resiliently biased cam. In another embodiment, the locking means may comprise a cleat.

The locking means may be provided with an unlocking means for switching the locking means from a locked state to an unlocked state. The unlocking means may be adapted to unlock the locking means in any suitable fashion. The unlocking means may be provided as part of the locking means, may be positioned remotely from the locking means, e.g. on another element of the assembly. In one embodiment, the unlocking means may comprise a lever attached to the locking means, the lever being operated by an unlock line which is attached at one end to the lever. In another embodiment, the unlocking means may comprise an unlocking element provided on at least one of the elongate flexible members.

The unlocking means may be provided with an unlock actuating means which may be provided remotely from the locking and/or unlocking means. The unlock actuating means may be provided in any suitable position on the assembly, including but not limited to the actuating means. The unlock actuating means may actuate the unlocking means in any suitable fashion. In one embodiment, the unlock actuating means may comprise an unlock line as described above, wherein the unlock line is attached at a second end to any suitable feature of the assembly or other element, and wherein the unlock line is actuated by any suitable means. In an embodiment, the unlock line is attached at its second end to a button provided on the actuating means, and is actuated by a user actuating the button. In another embodiment, the unlock line is attached to an element remote from the actuating means, but is in sliding engagement with the actuating means, the unlock line being actuated by movement of the actuating means. In a further embodiment, the unlock actuating means may comprise a formation or feature provided on the actuating means, the formation or feature being operable to differentially extend at least one of the elongate flexible members so as to bring an unlocking element attached to the at least one elongate flexible member into contact with the locking means, thereby to unlock the locking means. The assembly may be provided with a guiding means for guiding the elongate flexible members, for example to facilitate operation of the assembly. The guiding means may be positioned in any suitable position. In one embodiment, the guiding means is positioned adjacent to the top aperture. The guiding means may be provided with friction reducing means, including but not limited to a friction reducing coating or friction reducing formations or features. The guiding means may be provided with a directional guidance means to enable a user to guide the elongate flexible means in a particular direction. In one embodiment, the guiding means may be formed as a flexible tube. In an alternative embodiment, the guiding means may guide the elongate flexible members along the length of a shoulder strap, for example for a bag or backpack.

The assembly may have any suitable plurality of elongate flexible members. In one embodiment, the assembly comprises three elongate flexible members. In an alternative embodiment, the assembly comprises four elongate flexible members. In a further embodiment, the assembly comprises five elongate flexible members. The elongate flexible members may have any suitable shape and may be made of any suitable material, including but not limited to plastics materials, fibrous materials or metals. The elongate flexible members may be made of a wear-resistant material. In one embodiment, the flexible members may be lines made of nylon. In an alternative embodiment, the flexible members may be made of Kevlar™. In a further embodiment, the flexible members may be made of fishing line.

Each of the elongate flexible members may be permanently or releasably attached to the load carrying portion by any suitable means. In one embodiment, each of the elongate flexible members are attached to anchors provided on the surface of the load carrying means. The anchors may be arranged in any suitable configuration on the surface of the load carrying means. In one embodiment, the anchors may be arranged in a substantially identical configuration to the configuration of apertures on the supporting frame. The anchors may be fixed in position on the surface of the load carrying means, or may alternatively be adapted to actuate in one or more dimensions. Alternatively or additionally, the anchors may be resiliently biased by a suitable means. In an embodiment, the anchors may be provided with anchor engagement means adapted to engage with the corresponding engagement means provided on the edges of the apertures of the supporting frame. In an alternative embodiment, the anchor engagement means may be adapted to indicate to a user when engaging with the corresponding engagement means on the supporting frame.

Each of the elongate flexible members may any suitable length. In one embodiment, each of the elongate flexible members may have a length so as to, during movement of the load carrying portion between the extended and retracted positions, maintain the spatial orientation of the load carrying portion.

One or more of the elongate flexible members may be provided with a guide element adapted to engage with an aperture of the supporting frame when the assembly is in the retracted position, thereby to prevent relative movement between the elongate flexible member and the respective aperture of the supporting frame. The guide element may take any suitable form and be made of any suitable material. In one embodiment, the guide element may be substantially tubular and may be made of a rigid plastic material. The guide element may be attached to the elongate flexible member in a suitable fashion, including but not limited to welding or adhesives.

The elongate flexible members may be provided with a sheath element. The sheath element may substantially enclose one, several or all of the flexible members along at least a portion of their length. The sheath element may additionally enclose other elements of the assembly, or portions thereof, including but not limited to the locking means or the actuating means. The sheath element may be attached to either or both of the actuating means and the locking means. The sheath element may be made of any suitable material, including but not limited to Nylon™ or Lycra™. In one embodiment, the sheath element may be made out of an at least partially elastic material.

The actuating means may be any suitable shape to enable a user to grip it for actuating the load carrying portion. The actuating means may be provided with formations or features for improving a user's grip. The actuating means may be made of any suitable material, including but not limited to plastics materials or metals. In one embodiment, the actuating means is made of a material which improves a user's grip thereon.

The actuating means may be fitted with retention means for retaining the ends of the flexible elongate members. In one embodiment, the retention means releasably retains the ends of the flexible elongate members. This allows a flexible member to be easily exchanged or repaired. In another embodiment, the elongate members are permanently affixed to the retention means by a suitable means, including but not limited to heat welding or adhesives.

The assembly may be provided with a retention means for retaining at least one of the elongate flexible members and/or the sheath element, thereby to avoid that the members and/or the sheath element get caught or tangled when not in use. The retention means may retain the flexible members and/or sheath element in any suitable fashion. In one embodiment, the retention means may comprise a resiliently biased spooling, coiling or similar mechanism provided in the actuating means. In an alternative embodiment, the retention means may comprise formations or features provided in connection with any part of the assembly and/or any other appropriate elements.

The assembly may be provided with an attachment means for releasably retaining the actuating means thereagainst. The attachment means may be permanently or releasably attached to the assembly by any suitable means. The attachment means may have any suitable shape or retaining mechanism for releasably retaining the actuating means. In one embodiment, the attachment means may comprise a directional, magnetic clasp. In another embodiment, the attachment means may comprise an aperture for inserting the actuating means thereinto. In an alternative embodiment, the attachment means may comprise a clamp or clasp. In yet another embodiment, the attachment means may comprise a plurality of different retaining means.

In accordance with a second aspect of the invention, there is provided a backpack, comprising: a back portion, the back portion comprising a carrying means for enabling the back portion to be carried by a user; a load carrying portion; an actuating assembly operable to move the load carrying portion between a retracted position, in which the load carrying portion is secured against the back portion by way of the actuating assembly, and an extended position, in which the load carrying portion is movably attached to the back portion by way of the actuating assembly; and an operating means operably connected to the actuating assembly, wherein the operating means is provided on the carrying means, and wherein the actuating assembly is operable in the extended position to allow a user to freely maneuver the load carrying portion relative to the back portion.

The load carrying portion may have any suitable shape for the transportation of items. In one embodiment, the load carrying portion may be shaped substantially like a conventional backpack.

The back portion may comprise a panel with a supporting structure or frame. This enables the back portion to provide increased support for a user's back and/or increased rigidity of the back portion. The back panel may have substantially the same shape and dimensions as a back surface of the load carrying portion.

The actuating assembly may comprise any suitable means for moving the load carrying portion between the extended and retracted positions. In one embodiment, the actuating assembly may be substantially identical to the assembly of the first aspect of the invention.

The backpack may be provided with features or formations to facilitate the operation of the actuating assembly, so as to render access to any part of the actuating assembly easier or more convenient for a user. In one embodiment, a strap of the backpack may be provided with a strap extension on which the attachment means for the actuating means is placed to make it easier for a user to reach. In one embodiment, the strap extension is positioned at a lower end of at least one of the straps.

The backpack may further be provided with a stowage means for releasably attaching the load carrying portion to any convenient portion of the backpack. The stowage means may be provided in any suitable location. In one embodiment, the backpack may comprise stowage means on one or both of the straps which are operable to engage with a corresponding stowage means on the load carrying portion, thereby to enable the backpack to be releasably attached to, and carried, to the user's front. In another embodiment, the stowage means comprises stowage hooks on the load carrying portion with corresponding loops provided on each of the straps.

Other aspects and embodiments of the invention are as described and claimed hereafter with advantages which will be apparent to the reader.

BRIEF DESCRIPTION OF DRAWINGS

Embodiments of the invention will now be described, by way of example only, with reference to the accompanying drawings, of which:

FIG. 10 is a frontal perspective view of a handle of the first embodiment;

FIGS. 11*a* and 11*b* are schematic views of a flexible sheath of the first embodiment;

Figure 1:
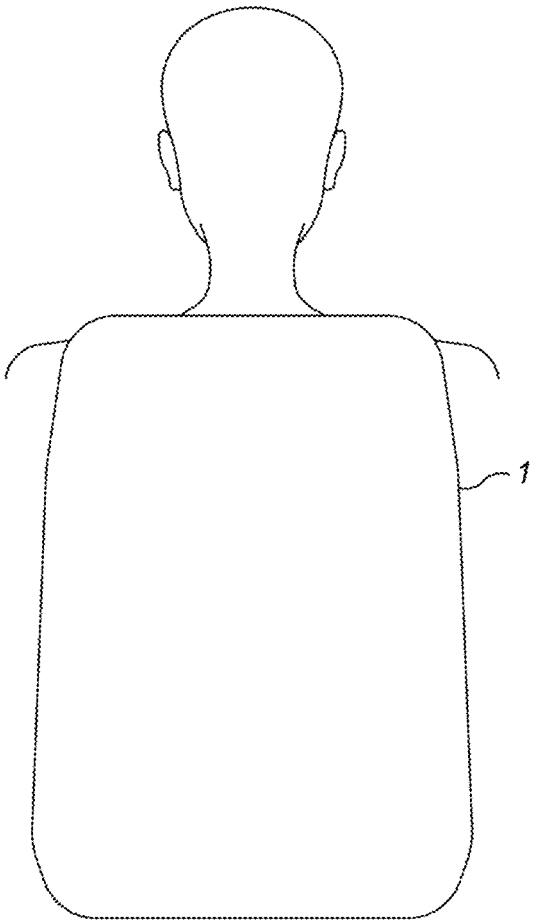
FIG. 1 is a rear view of a backpack of a first embodiment with the luggage pack in a retracted position.

In the following, similar features and features performing similar or identical functions of the various embodiments will be denoted by the same reference numerals. Furthermore, it is pointed out that the features of the each of the following embodiments may be used in combination with the features of each of the other embodiments.

Figure 2:
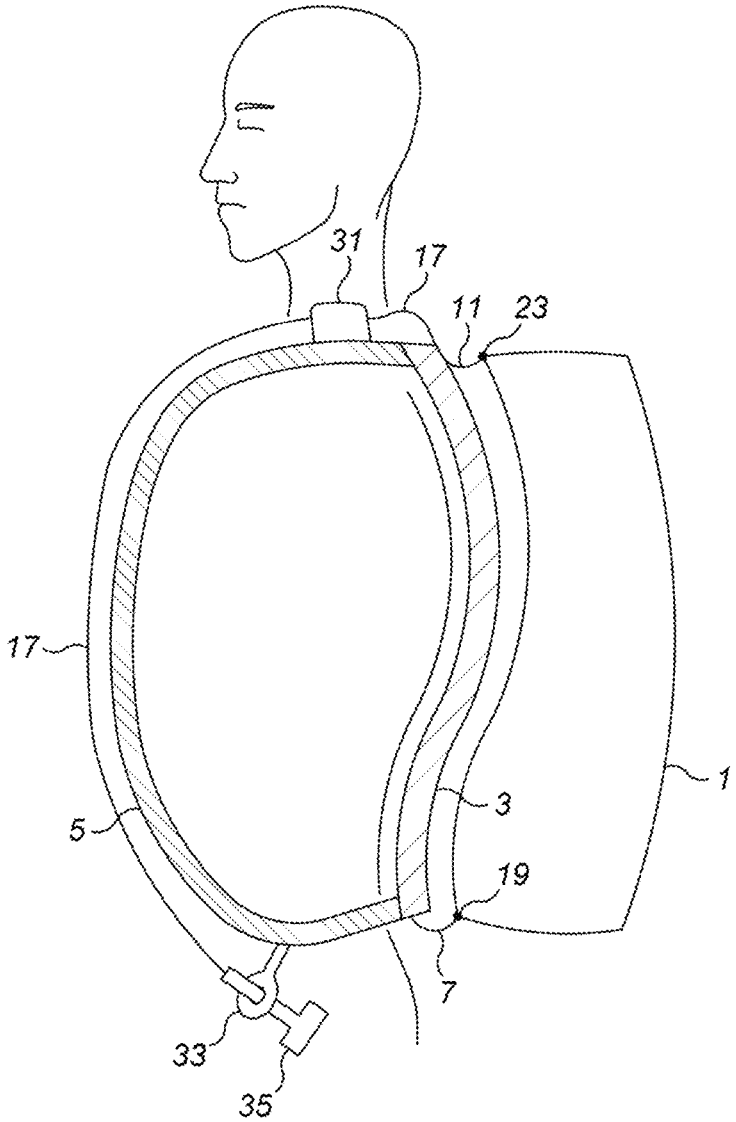
FIG. 2 is a side sectional view of the backpack of FIG. 1.
Figure 3:
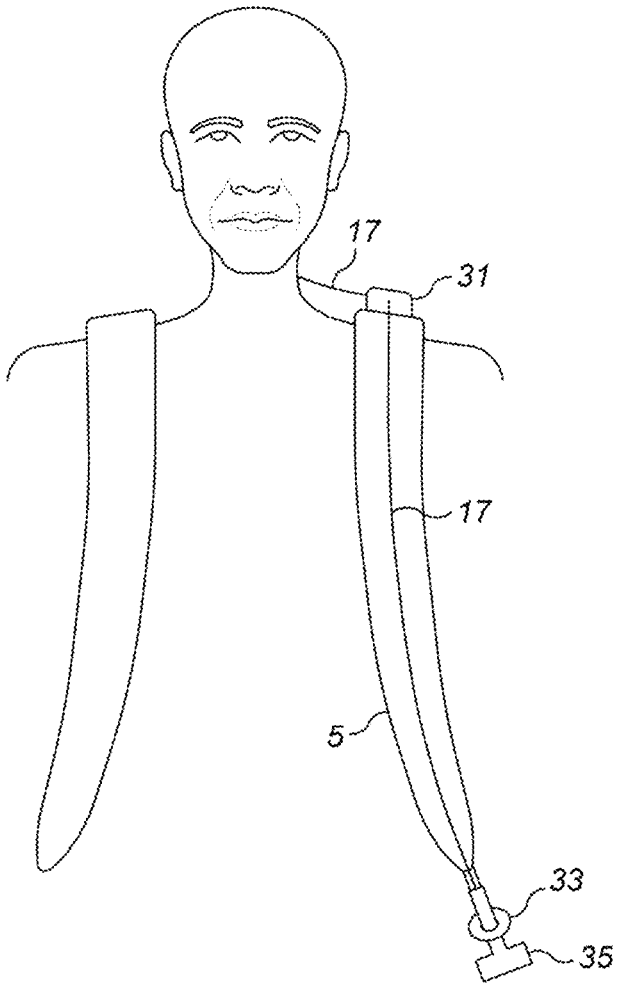
FIG. 3 is a frontal view of the backpack of FIG. 1.

Referring to FIGS. 1-3, a backpack according to a first embodiment of the invention has a luggage pack (1), which is connected by way of a number of nylon cord lines (7, 11, 15) to a back panel (3). It is of course to be understood that, although nylon cord is specified, any suitable line material, or combination of materials could be used. In the present example, the luggage pack is connected to the back panel by three lines, which has been found to give a controllable movement. The back panel is fitted with conventional shoulder straps (5) (and optionally with waist and chest straps) which allow a user to carry the backpack in a conventional manner.

The luggage pack (1) has a front surface and a back surface. The back surface faces towards the user when the backpack is in use, and the front surface faces away from the user when in use. The front surface has a number of openings, coverings and flaps to enable a user to store and carry items in the luggage pack in a conventional manner.

A number of anchors (19, 23, 27) are attached to the edge of the back surface of the luggage pack (1), each for attaching a respective line. The first anchor (23) is attached substantially at the top of the back surface. Second (19) and third (27) anchors are attached at the bottom corners of the back surface of the luggage pack.

Figure 7:
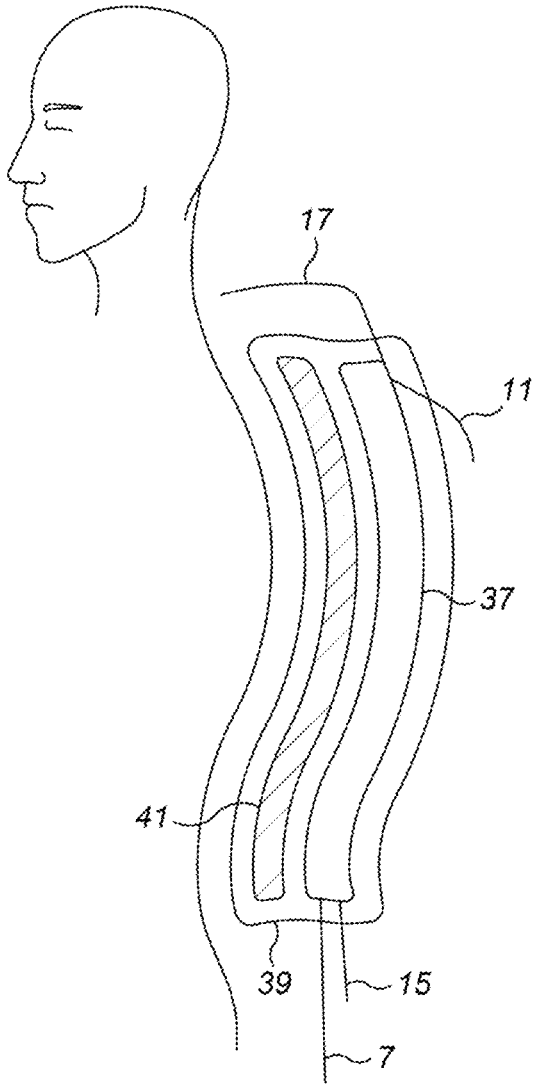
FIG. 7 is a sectional side view of the back panel.

Referring to FIG. 7, the back panel (3) has an outer cloth wrap layer (39) which completely surrounds a transport frame (37). A foam layer (41) can be placed in between the cloth wrap layer and the transport frame towards the side of the transport frame which faces a user when the back panel is being worn. The foam layer (41) provides padding to improve wearability and comfort for the user.

Figure 8A:
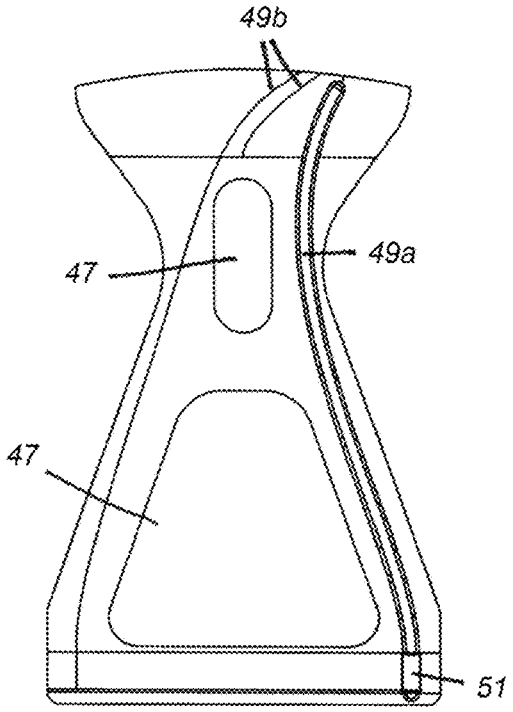
FIG. 8*a* is a frontal view of a molded planar element of the first embodiment.
Figure 8B:
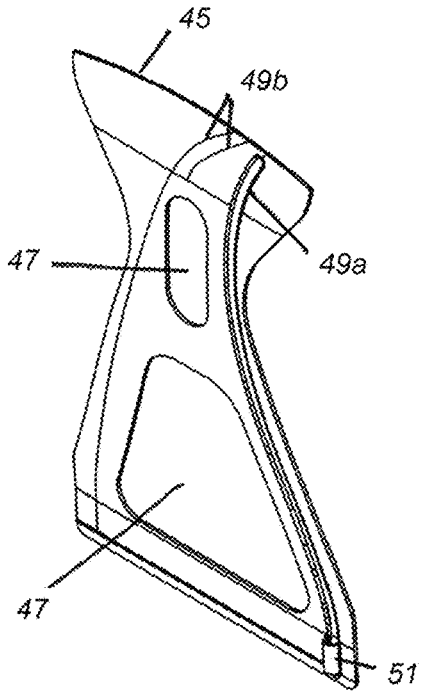
FIG. 8*b* is a frontal perspective view of the element of FIG. 8*a;*
Figure 9A:
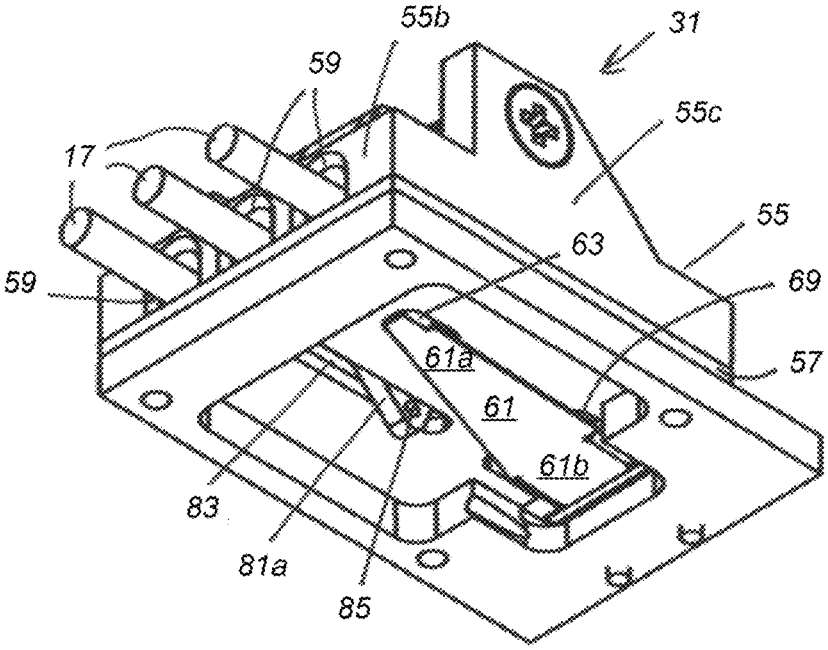
FIG. 9*a* is a bottom perspective view of a locking unit of the first embodiment.
Figure 9B:
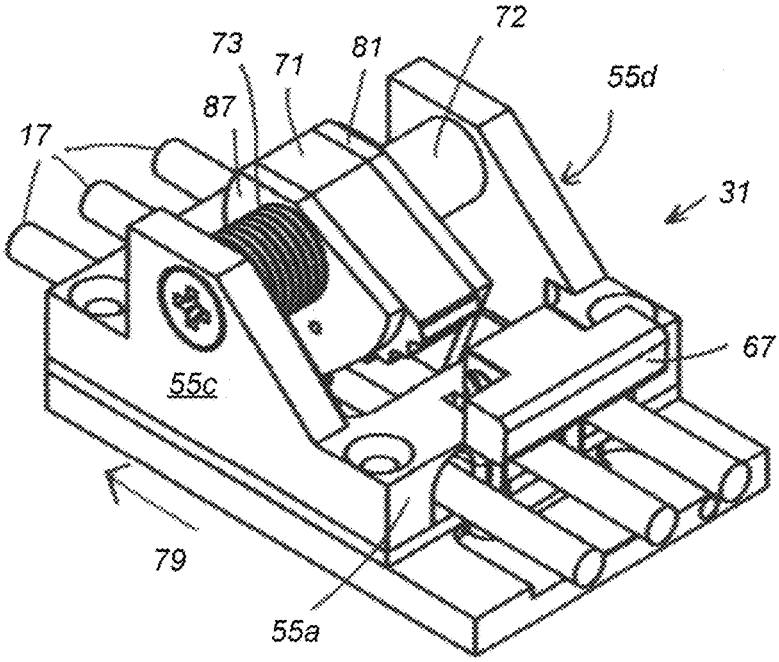
FIG. 9*b* is a top perspective view of the locking unit of FIG. 9*a;*
Figure 9C:
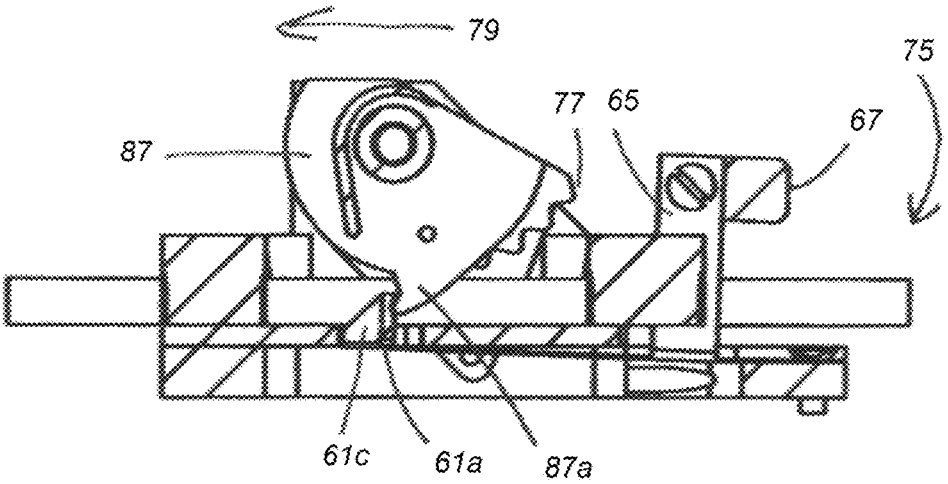
FIG. 9*c* is a cutaway side view of the left side of the locking unit of FIG. 9*a,*
Figure 9D:
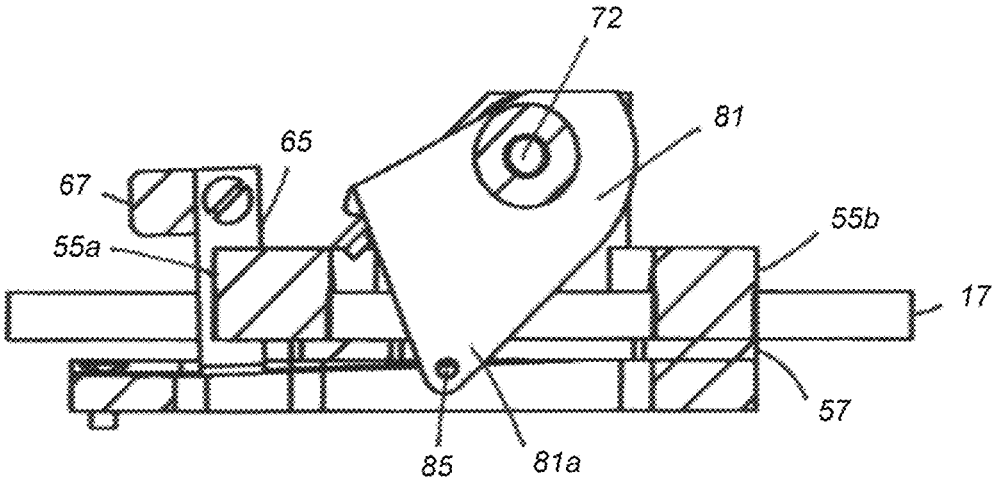
FIG. 9*d* is a cutaway side view of the right side of the locking unit of FIG. 9*a;*

Referring to FIGS. 8*a-b*, the transport frame (37) consists of a molded back plate (45). The back plate is shaped so as to conform to, and support, a user's back when in use. The back plate element has a number of apertures (47) formed in the surface thereof. These apertures improve airflow to the user's back, as well as decrease the amount of material needed.

The back plate has a number of grooves (49) formed on its surface. Only one of the grooves (49*a*) is shown in FIG. 9, but the positions of the other grooves are indicated by the lines (49*b*). Each of the grooves (49) has a circular cross section. Tubular fittings (51) are positioned at one end of each of the grooves. Optionally, further tubular fittings may be positioned towards the middle of, or at intervals along, each of the grooves. Each of the tubular fittings has an aperture with an external radius matching that of the respective groove. The back plate can be formed so as to raise the lower end of the central groove and the respective tubular fitting away substantially perpendicularly away from the surface. This reduces the risk that a line, passing through a tube inserted into the tubular fitting (see below), will rub against an part of the back plate, thereby reducing wear on the line as well as friction when the line moves.

A tube (53—not shown) is positioned in each of the grooves (49), each tube having an aperture (55) at both ends thereof. Each of the tubes has an outer radius which is identical to the internal radius of the tubular fittings (51). The tubes are attached to the molded back plate (45) by a suitable means, such as an adhesive. The lower end of each of the tubes is inserted into the tubular fitting of the corresponding groove. When the transport frame is in an assembled state, the grooves (49) act to maintain the spatial configuration of each of the tubes on the surface of the back plate, and the tubular fittings (51) maintain the position and orientation of the lower ends of the tubes (53).

Each of the tubes (53) is oriented and positioned so as to minimise friction between a tube and its respective line during operation. The arrangement of the lower apertures of the tubes is substantially identical to the arrangement of the anchors attached to the back of the luggage pack. This ensures that, when the luggage pack (1) is in the retracted position, the anchors (19, 23, 27) are held immediately adjacent to the corresponding entry apertures. In this fashion, the luggage pack is held tightly against the back panel, which prevents any unwanted or accidental movement of the luggage pack relative to the back panel.

Figure 4:
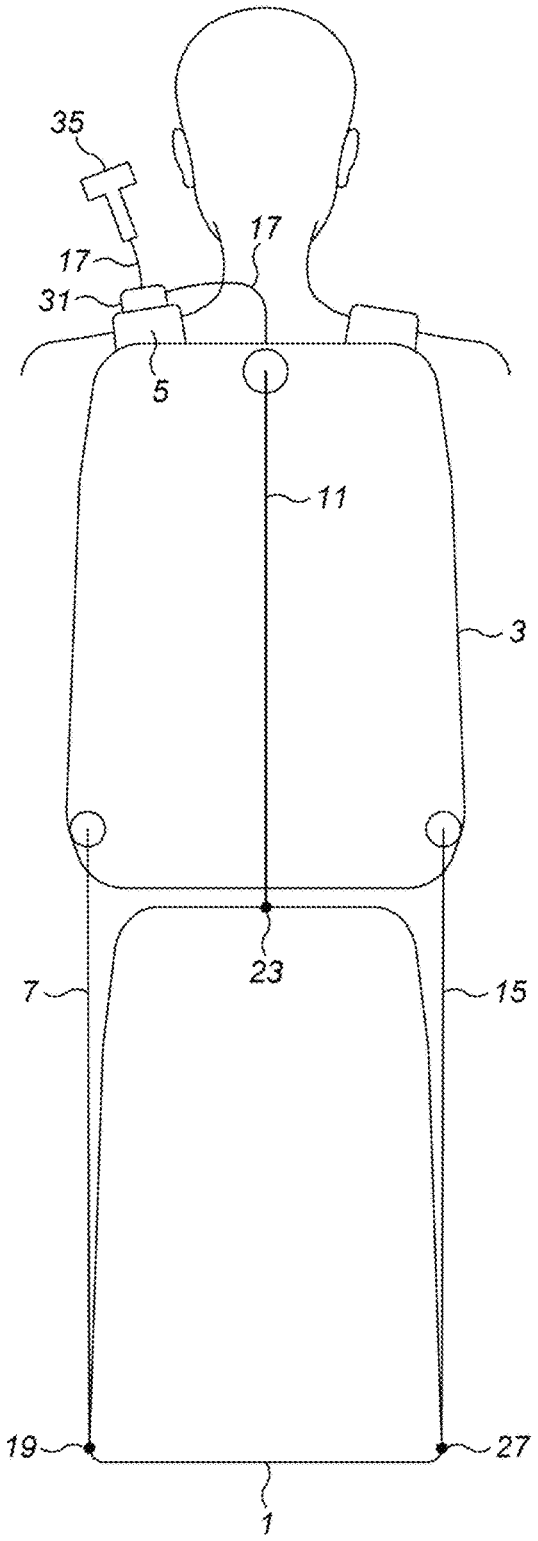
FIG. 4 is a rear view of the backpack of FIG. 1, but in the extended position.

Referring to FIG. 4, each of the lines (7, 11, 15) is attached to one of the anchors (19, 23, 27) in the following fashion; the first line (11) is attached to the first anchor (23); and second (7) and third (15) lines are attached to the second (19) and third (27) anchors respectively.

Each of the lines (7, 11, 15) is guided through the lower aperture of the tube (53) corresponding to the anchor to which the respective line is attached, and through the respective tube to its upper aperture.

Referring to FIGS. 9*a-d*, the locking unit (31) has a frame (55) which is attached to a first surface of a base plate (57). The base plate has a number of apertures whose function will be explained in detail in the following. The frame has a front portion (55*a*) and a back portion (55*b*), and two side portions (55*c*, 55*d*) connecting the front and back portions. The frame has a number of apertures (59) on each of the front and back portion of the frame through which the lines (17) pass through the frame. The number of apertures on each of the front and back portion is equal to the number of lines. The side portions (55*c*, 55*d*) of the frame extend from the front and back portions in a direction away from the base plate.

A latching spring (61) has a fixed end (61*b*), which is attached to a second surface of the base plate (57). The free end (61*a*) of the latching spring has a latching portion (61*c*) which extends through a corresponding first aperture (63) in the base plate. The latching spring has an engagement portion (65) which extends perpendicularly from the spring, through a second aperture (69) in the base plate. An engagement surface (67) is located at the free end of the engagement portion. The engagement surface extends away from the front surface of, and substantially parallel with, the front surface of the front portion (55*a*) of the frame.

A cam (71) is rotatably mounted on a spindle (72) between the raised side portions of the frame (55*c*, 55*d*). The spindle is parallel to the base plate (57) and is perpendicular to the direction of the lines (17). The cam is biased by a biasing spring (73) to rotate towards the base plate, i.e. in a down direction (as indicated by arrow 75). The cam will therefore, under normal circumstances and absent any external actuation, engage with at least one of the lines (17) passing through the locking unit (31), i.e. into a locked position. In the present example, the cam engages with the central line, although in principle it could equally well engage with all of the lines. The cam is provided with a number of teeth (77) on the surface facing the line when the cam is in its locked position. The teeth are formed so as to hinder movement of the line in an extending direction (indicated by arrow 79), but facilitate movement of the line in the opposite, retracting, direction.

A lever (81) is attached to the cam (71). The lever extends away from the cam towards the baseplate (57), and is dimensioned so that the free end (81*a*) of the lever extends through a third aperture (83) in the base plate. The lever (81) is oriented relative to the cam (71) so that when the cam is in its normal position, i.e. in engagement with the line, the lever points substantially towards the back portion (55*b*) of the frame (55) of the locking unit (31). The free end of the lever has an anchor point (85) to which an actuating line (95, not shown) can be attached.

A latch (87) is attached to the cam (71), extending away from the cam in substantially the same direction as the lever (81). The latch has a free end (87*a*), which is adapted to interact with the latching portion (61*c*) of the free end (61*a*) of the latching spring (61) when the cam is rotated into an unlock position.

The locking unit (31) has two configurations; a first configuration in which the cam is in its unlock position, wherein the lines (17) are able to pass freely through the locking unit; and a second configuration in which the cam is in its locked position, wherein the cam frictionally retains the lines.

Referring to FIG. 10, the lines (17) are at one end attached to a handle (35). The handle has a number of apertures (89) into which the lines can be inserted to attach them to the handle. The handle has an actuating button (91) placed in a convenient location for a user to reach when holding the handle. The handle has a further aperture (93) for an actuating line (95, not shown) to pass through.

To prevent the lines (17) catching on the user or other objects whilst the handle (35) is attached to the clip (33), the lines should ideally be kept taut against the strap (5). However, this only allows the lines to have a very limited length, which generally does not allow for sufficient travel of the luggage pack to be conveniently movable to the front of the user. To increase the possible length of travel of the luggage pack, it is possible to increase the length of the lines (17). However, this requires the handle to be mounted further down the strap, or even on the luggage pack itself, in order to keep the lines taut against the strap when the handle is mounted in the clip, which makes the handle more difficult or inconvenient to reach.

Referring to FIGS. 11*a-b*, the lines (17) are surrounded by a flexible tubular sheath (97) made of an elastic material, such as a combination of Nylon™ and Lycra™. The sheath surrounds the lines, thereby preventing the user or other objects from becoming tangled or caught. One end of the sheath is attached to the locking unit (31), or to the strap (5)

immediately adjacent to the locking unit. The other end of the sheath is attached to the handle (35). The sheath has a length such that, when the handle is attached to the clip, the sheath is kept taut against the strap, and by extension the user's body, by only partially elastically deforming the sheath material (as shown in FIG. 11*a*). Since the lines are surrounded by the sheath, the lines themselves need not be under tension when the handle is mounted in the clip. This allows the lines to be longer, thereby increasing the potential travelling distance of the luggage pack (1). Further, it reduces the risk that the lines are caught on something, as they are taut against the strap. Yet further, it allows the clip to be mounted in a more convenient position. If a user pulls on the handle (35), the elasticity of the sheath allows the user to pull the lines (17) taut (as shown in FIG. 11*b*).

Figure 12:
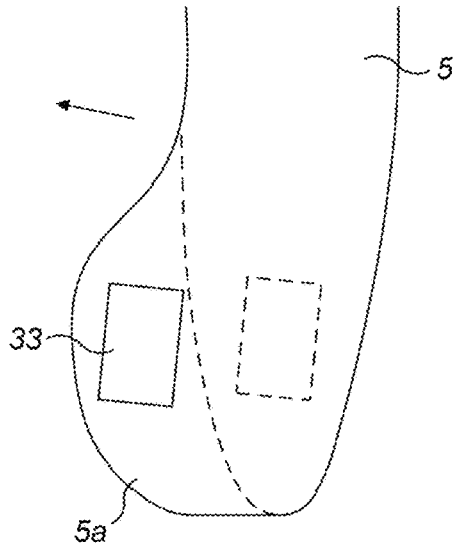
FIG. 12 is a schematic view of a lower end of a strap of the first embodiment.

Referring to FIG. 12 (as well as FIGS. 3, 5 and 6) a clip (33) is attached to the same strap (5) as the locking unit (31) near the lower end thereof. When the luggage pack (1) is in the retracted position, the handle (35) is attached to the clip (33). The clip can for example be a Fidlock™. To remove the handle from the Fidlock™, the user moves the handle in a downwards motion which releases the handle from the clip. Other types of clips or holders, which provide an analogous function, can equally well be used, either alone or in combination with any other clips or holders, so as to improve retention of the handle or reduce the risk of the handle becoming dislodged.

Figure 5:
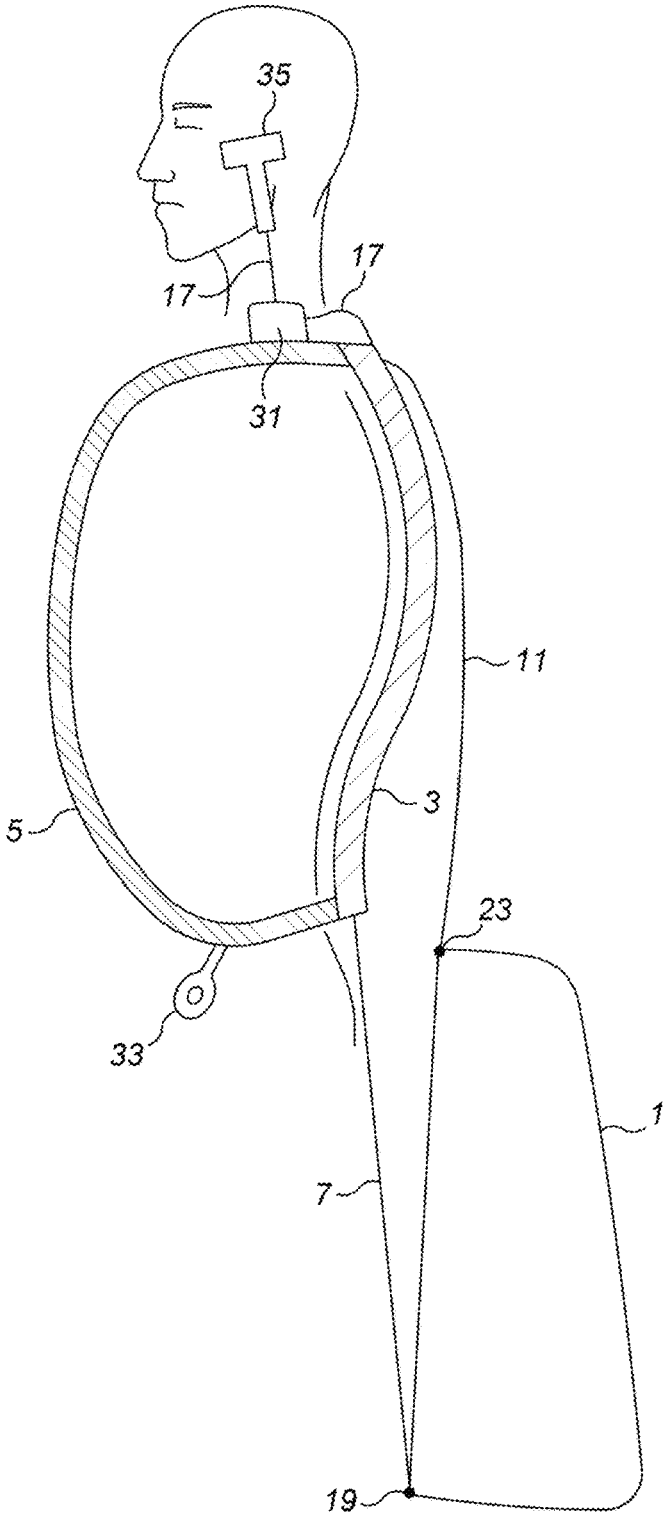
FIG. 5 is a sectional side view of the backpack of FIG. 4.
Figure 6:
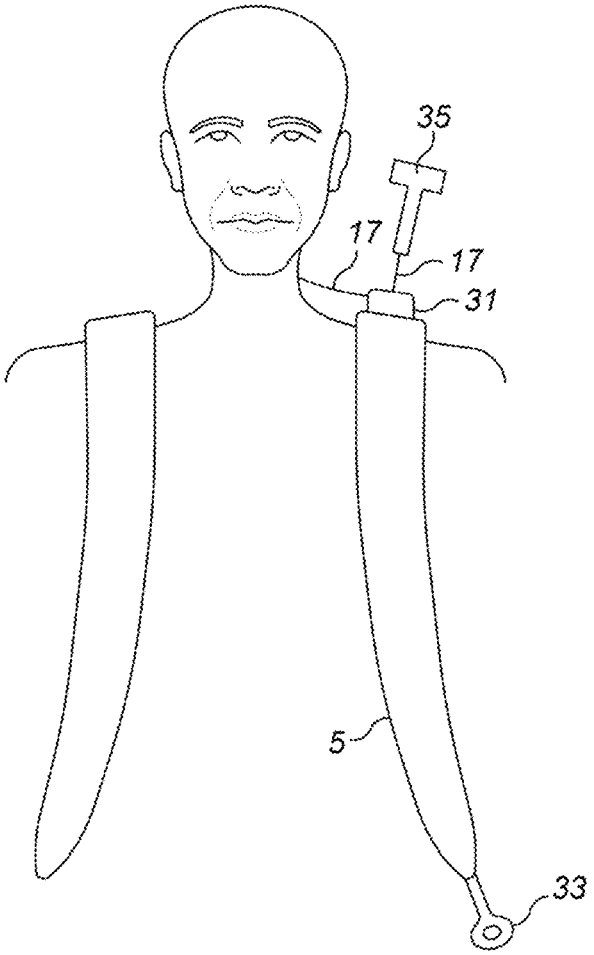
FIG. 6 is a frontal view of the backpack of FIG. 4.

In FIGS. 4-6, the luggage pack (1) is in the extended position suspended via the lines (7, 11, 15). In this position, the luggage pack (1) has the same spatial orientation as in the retracted position. This ensures that the contents of the luggage pack do not swivel, move or tumble during movement between the extended and retracted positions.

Referring to FIGS. 3 and 6, each of the straps (5) of the backpack has a stowage hook (not shown) provided thereon. This enables a user to, when the luggage pack (1) is in the extended position, bring the luggage pack around to the user's front and then to releasably secure the luggage pack against the user's front. The user can then freely access the contents of the luggage pack with both hands. When the user is finished, the luggage pack can be released from the stowage hooks.

Further, the strap (5) to which the clip (33) is attached can have one or more features (not shown) which prevent the sheath and/or lines from sliding off the sides of the strap when the handle is mounted in the clip. This reduces the risk of the user, or other objects, becoming entangled in the lines.

In use, the backpack is movable between a retracted position as shown in FIGS. 1-3 and an extended position as shown in FIGS. 4-6. In the retracted position, the luggage pack (1) is held tightly against the back panel (3). In this position, the lines (17) are frictionally retained by the locking unit (31) and the handle (35) is attached to the clip (33).

If the lines are pulled in the extending direction whilst the cam (71) is in the locked position, for example by a heavily loaded luggage pack, the middle line engages with the teeth (77) of the cam (71), and cause the cam to turn in the downwards direction. This, in turn, causes the teeth to press down on the middle line further, thereby preventing the line from moving in the extending direction. Conversely, if a user pulls the lines in the retracting direction, the teeth do not interact with the line to prevent the movement of the lines. Rather, the line will merely cause the cam to rotate slightly towards the unlock position. Hence, the user will be prevented from pulling the lines in an extending direction, i.e. the luggage pack cannot be moved towards the extended position, whether accidentally or not. However, the luggage pack can easily be moved towards the retracted position.

To be able to move the luggage pack (1) from its retracted position, a user firstly releases the handle (35) from the clip (33). The user then holds the handle so as to render the lines (17) taut, and then presses the actuating button (91) of the handle. This causes the actuating line (95) to pull the lever (81) of the cam (71), thereby causing the cam to rotate against the biasing direction of the biasing spring (73) into the unlocked position.

The rotation of the cam also rotates the latch (87), which is attached to the cam. The rotation causes the free end the latch to engage with the latching portion (61*c*) of the free end (61*a*) of the latching spring (61). The latching spring thereby holds the cam (71) in the unlock position wherein the teeth (77) of the cam are not in engagement with the lines (17). This allows the lines to freely move in both the extending and the retracting direction.

The user can then, by moving the handle (35) towards the locking unit (31), move the luggage pack (1) towards the extended position. In the fully extended position, the handle and/or the compressed sheath will come into contact with the engagement surface (67) of the engagement portion (65) of the latching spring (61). This will push the engagement surface towards the front surface of the front portion (55*a*) of the frame, thereby causing the latching spring to elastically deform and effectively pivot about the fixed end (61*b*). The free end (61*a*) of the latching spring will hence move downwards, away from the latch (87) of the cam (71). The biasing spring (73) will cause the cam to turn into the locked position and frictionally retaining the lines (17).

Whilst in the extended position, the user can reach behind to either side at waist level, and pull the luggage pack round to his or her front to access the contents, or to place it on the lap whilst sitting. Alternatively, the user can removably attach the luggage pack to the front of the straps by way of a number of attachment hooks or clips positioned on the straps (5).

To return the luggage pack (1) to its retracted position, the user merely has to release it and pull the handle (35) in the retracting direction until the luggage pack is fully retracted. The user then replaces the handle in the clip (33).

Referring to FIG. 12, the lower end of the strap (5) is formed with an inwardly projecting portion (5*a*) to which the clip is attached. When the backpack is worn by a user, the inwardly projecting portion substantially points towards the users front (as indicated by the arrow), thereby positioning the clip (33) closer to the user's front. The user therefore does not have to reach as far backwards to reach the clip as would have been necessary with a conventional strap with a conventionally mounted clip (as indicated by the dashed lines), thereby decreasing the inconvenience to the user.

Figure 13A:
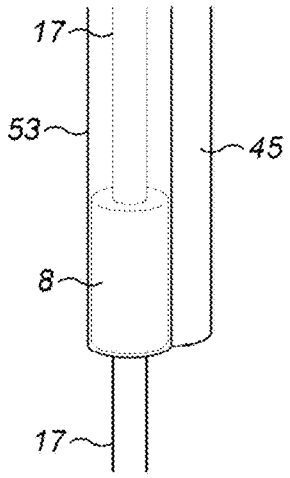
FIGS. 13*a-b* is a schematic view of a line retainer of the first embodiment.
Figure 13B:
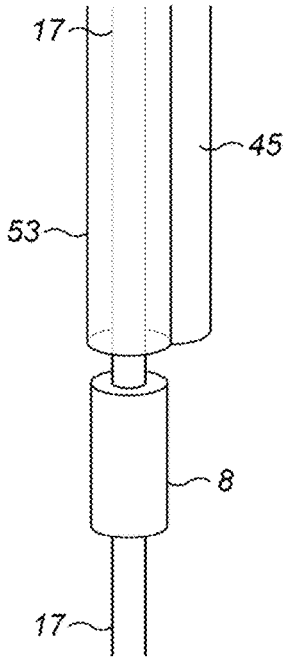

Referring to FIGS. 13*a-b*, one or more of the lines (17) may not be retained by the cam (71) when the cam is in the locked position. To prevent relative movement of the lines with respect to the back panel (3), and hence preventing relative movement of the luggage pack (1) with respect to the back panel, each of the non-retained lines have a line retainer (8) attached thereto. The line retainers are made of a rigid material, such as plastic or metal. Each line retainer is positioned on the lines so that, when luggage pack is in the retracted position, the line retainers engage with the respective tubes (53), which are attached to the back plate (45) of the back panel (3), as shown in FIG. 13*a*. This prevents the line from moving relative to the tube, thereby preventing the luggage pack from moving relative to the supporting frame.

When the luggage pack is in the extended position, as shown in FIG. 13*b*, the retainer allows free movement of the line relative to the tube.

Figure 14A:
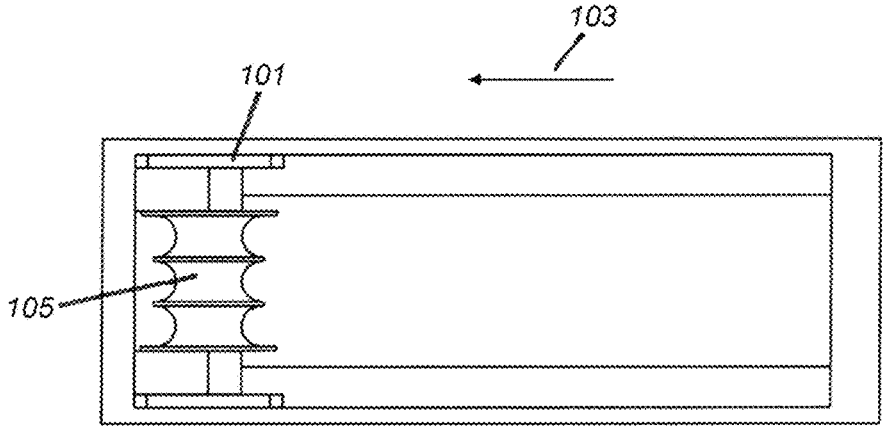
FIGS. 14*a-c* are views of a handle with a spooling mechanism of the first embodiment.
Figure 14B:
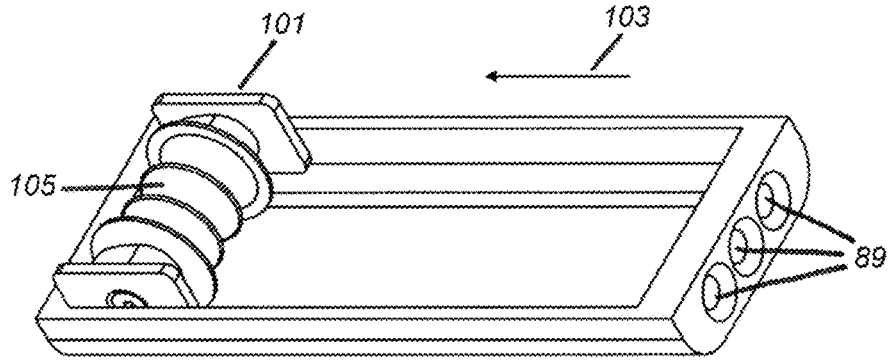
Figure 14C:
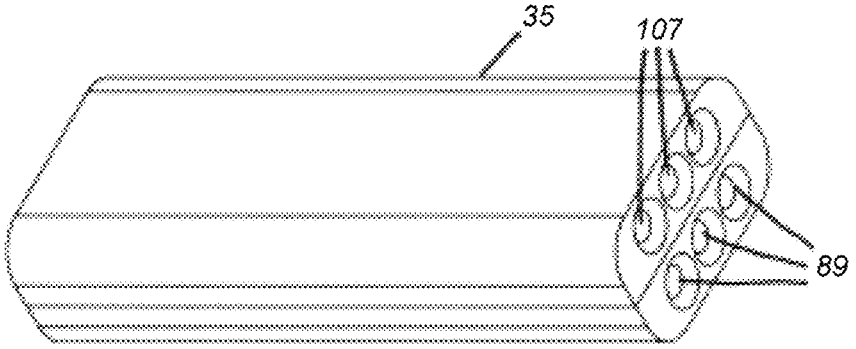

Referring to FIG. 14, the handle (35) may optionally be provided with a spooling mechanism to keep the lines (17) taut when the handle is mounted on the clip (33) in addition to, or in combination with, the sheath (97). The handle has a number of apertures (89), through which the lines (17) can pass. The spooling mechanism consists of a movable frame (101), which is resiliently biased in a suitable manner towards the end of the handle opposite the apertures (89), i.e. in the direction indicated by the arrow (103). A reel (105) is rotatably mounted on the movable frame. The lines pass through the apertures (89) and pass around the reel. The free end of the lines are attached to the handle (35) at the exit apertures (107) in a suitable fashion. When the handle (35) is attached to the clip (33), the movable frame will cause the lines (17) to be drawn into the handle, effectively picking up any slack in the lines, thereby pulling the lines taut, for example against the strap of the backpack.

As the lines run through the tubes (53), and then over the shoulder of the user through the locking unit and to the clip, they follow gently curved paths of wide radius and are thus less likely to kink, or jam due to friction, than in prior arrangements such as that of the above-mentioned German patent. Further, the user is able to elevate the luggage pack with a natural, strong, forwards movement, and to release it from the elevated position by actuating the release mechanism prior to lowering it.

Figure 15:
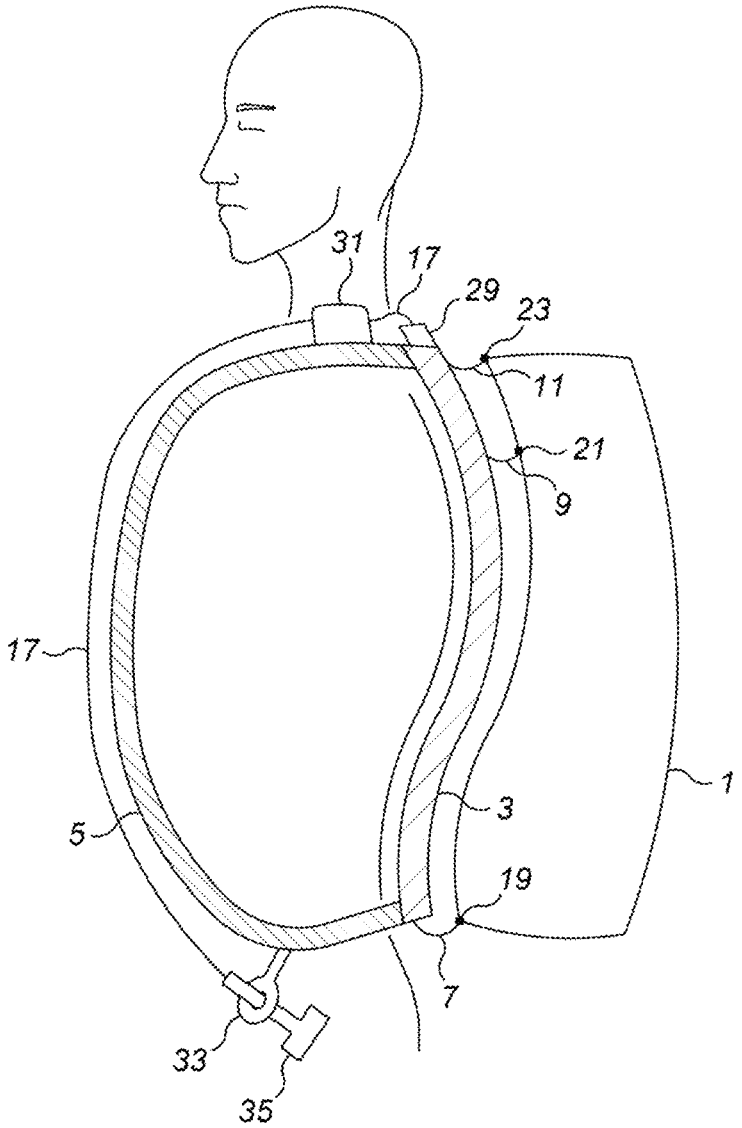
FIG. 15 is a side sectional view of a backpack of a second embodiment with the luggage pack in a retracted position.
Figure 16:
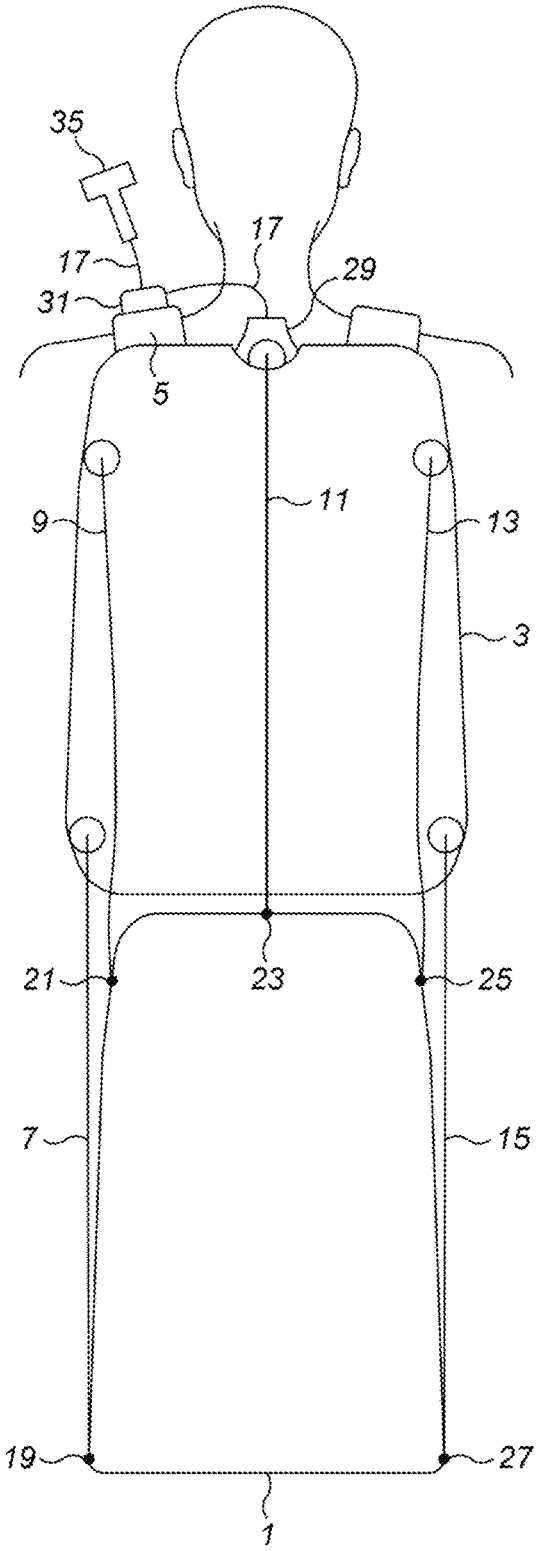
FIG. 16 is a rear view of the backpack of FIG. 15, but in the extended position.
Figure 17:
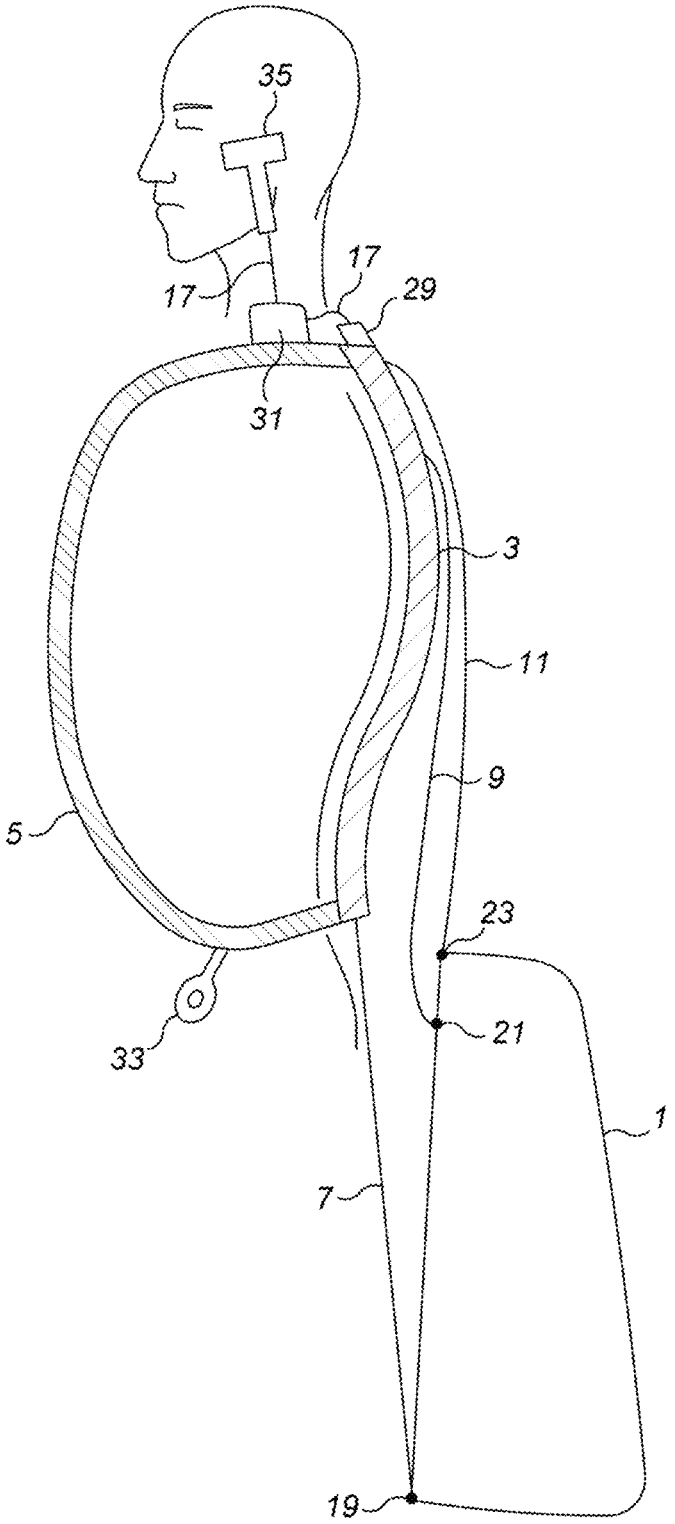
FIG. 17 is a sectional side view of the backpack of FIG. 16.

Referring to FIGS. 15-17, a backpack according to a second embodiment of the invention has a luggage pack (1) which is connected by way of a number of nylon cord lines (7, 9, 11, 13, 15) to a back panel (3). In the present example, the luggage pack is connected to the back panel by five lines, which has been found to give a controllable movement. The back panel is fitted with conventional shoulder straps (5) (and waist and chest straps), which allow a user to carry the backpack in a conventional manner.

The luggage pack (1) has a front surface and a back surface. The back surface faces towards the user when the backpack is in use, and the front surface faces away from the user when in use. The front surface has a number of openings, coverings and flaps to enable a user to store and carry items in the luggage pack in a conventional manner.

A number of anchors (19, 21, 23, 25, 27, 29) are attached to the edge of the back surface of the luggage pack (1), each for attaching a respective line. The first anchor (23) is attached substantially at the top of the back surface. Second (21) and third (25) anchors are arranged symmetrically around the central vertical line of the back surface of the luggage pack (1). Fourth (19) and fifth (27) anchors are attached at the bottom corners of the back surface of the luggage pack.

Figure 18:
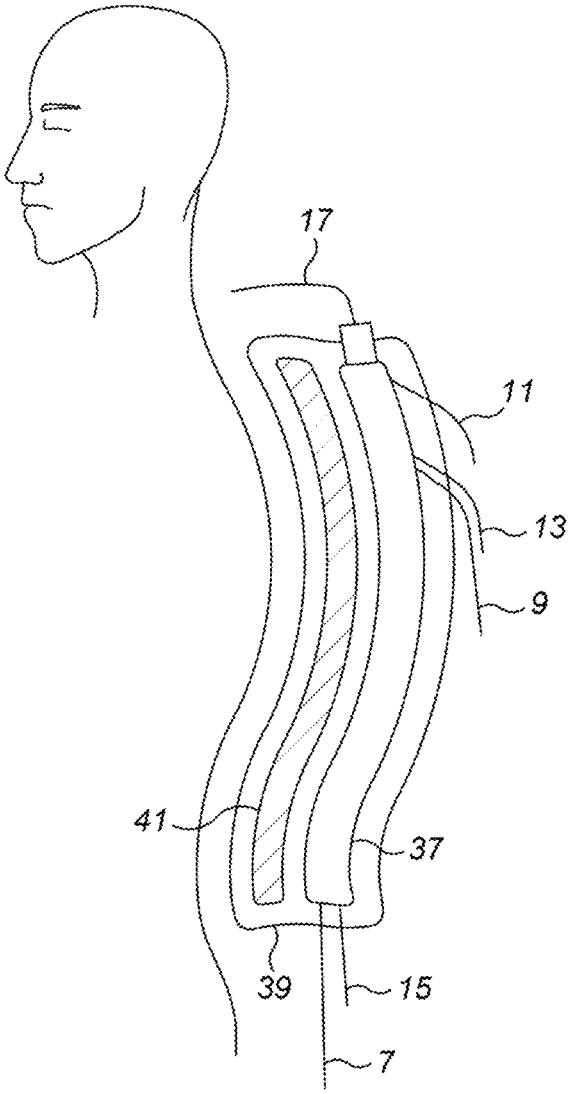
FIG. 18 is a sectional side view of the back panel.

Referring to FIG. 18, the back panel has an outer cloth wrap layer (39) which completely surrounds a transport frame (37). A foam layer (41) is placed in between the cloth wrap layer and the transport frame towards the side of the transport frame which faces a user when the back panel is being worn. The foam layer (41) provides padding to improve wearability and comfort for the user.

Figure 19:
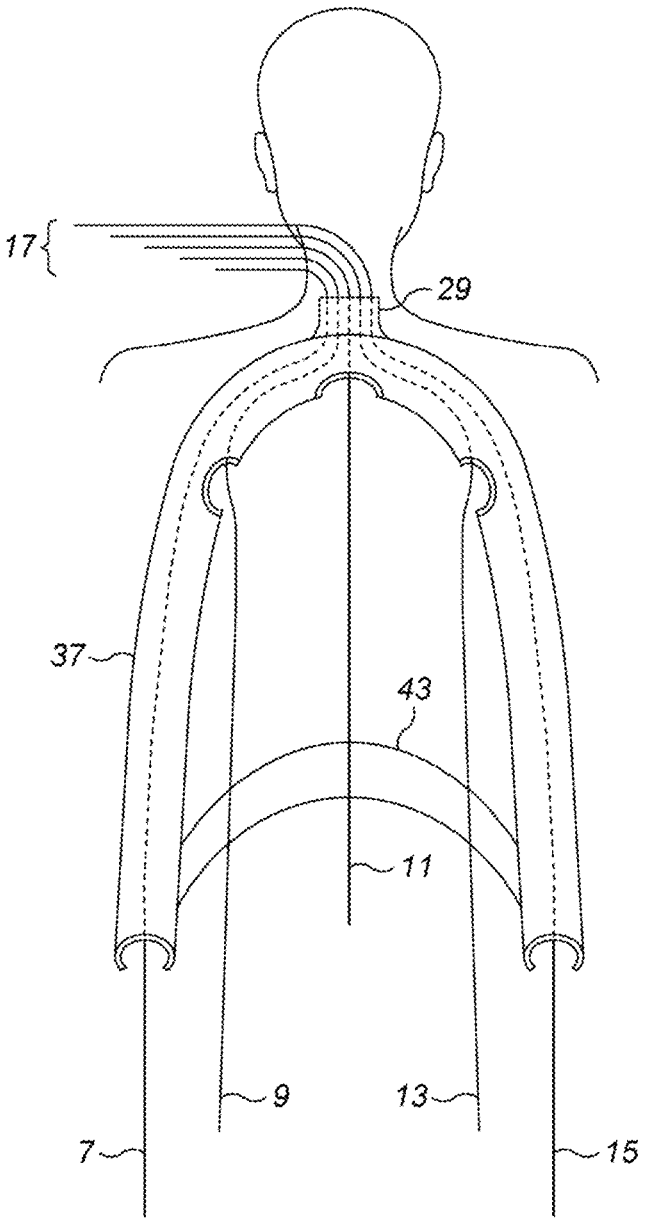
FIG. 19 is a rear view of the transport frame of the second embodiment.

Referring to FIG. 19, the transport frame (37) consists of a curved tubular element through which the lines can run. The transport frame is arranged with the top point of the curve facing substantially upwards and the free ends of the transport frame pointing substantially downwards when the backpack is in use. A curved brace element (43) is attached to the transport frame to provide additional rigidity and stability. The transport frame and brace element are made from a semi-rigid flexible plastics material. This allows the frame and brace to adapt to the shape of the user's back and the load carried in the luggage pack (1) whilst maintaining sufficient rigidity to ensure that the load forces from the luggage pack are stably and comfortably transferred to the user's back. The frame will additionally provide support to the user's back.

Both of the free ends of the transport frame (37) have an entry aperture formed therein for a line to pass through. Three additional entry apertures are formed in the transport frame: a first entry aperture on the point immediately below the top of the transport frame; and second and third entry apertures arranged symmetrically about the vertical central line of the frame. Each of the apertures is oriented and positioned so as to minimise friction during operation. The arrangement of the entry apertures is substantially identical to the arrangement of the anchors attached to the back of the luggage pack. This ensures that, when the luggage pack (1) is in the retracted position, the anchors (19, 21, 23, 25, 27) are held immediately adjacent to the corresponding entry apertures. In this fashion, the luggage pack is held tightly against the back panel, which prevents any unwanted or accidental movement of the luggage pack relative to the back panel.

An exit tube (29) for the lines is attached to the top point of the transport frame (37). The exit tube can be fitted or formed with friction reducing elements on its inside surface. This reduces the wear on the lines and reduces the amount of force needed to move the luggage pack (1) between the extended and retracted positions.

Each of the lines (7, 9, 11, 13, 15) is attached to one of the anchors (19, 21, 23, 25, 27) in the following fashion; the first line (11) is attached to the first anchor (23); second (9) and third (13) lines are attached to the second (21) and third (25) anchors respectively; and fourth (7) and fifth (15) lines are attached to the fourth (19) and fifth (27) anchors respectively.

Each of the lines (7, 9, 11, 13, 15) is guided through the entry aperture corresponding to the anchor to which the respective line is attached and through the transport frame, as indicated by the dashed lines in FIG. 20. Each of the lines is guided through exit tube (29) and pass through a cleat unit (31) which is attached to one of the straps (5).

The cleat unit (31) has two configurations; a first configuration in which the lines (17) are in an unlocked position and are able to pass freely through the cleat unit; and a second configuration in which the lines are in a locked position in which the cleat frictionally retains them. A user can move the lines (17) between the unlocked and locked positions by moving the lines respectively up away from and down towards the cleat unit.

The lines (17) are at one end attached to a handle (35). A clip (33) is attached to the same strap (5) as the cleat unit (31) near the lower end thereof. When the luggage pack (1) is in the retracted position, the handle (35) is attached to the clip (33). Each of the lines (17) has a length so that, when the handle is attached to the clip, the lines are substantially taut against the strap (5). This reduces the risk that either the handle (35) or the lines (17) will become entangled whilst the backpack is being worn by a user.

In FIGS. 16-18, the luggage pack (1) is in the extended position suspended via the lines (7, 9, 11, 13, 15). In this position, the luggage pack (1) has the same spatial orientation as in the retracted position. This ensures that the contents of the luggage pack do not swivel, move or tumble during movement between the extended and retracted positions.

In the extended position, the handle (35) rests against the cleat unit (31). If the lines (17) are in the unlocked position in the cleat unit (31), i.e. if the cleat unit is in the first configuration, the handle (35) will effectively be carrying the weight of the load in the luggage pack. In case of heavier loads, this may lead to damage to the handle. Thus, for such loads, the user may choose to lock the lines (17) into place by moving them into the locked position in the cleat unit (31).

In use, the back pack is movable between a retracted position as shown in FIG. 15 and an extended position as shown in FIGS. 16-18. In the retracted position, the luggage pack (1) is held tightly against the back panel (3). In this position, the lines (17) are frictionally retained by the cleat unit (31) and the handle is attached to the clip (33).

To be able to move the luggage pack (1) from its retracted position, a user firstly releases the handle (35) from the clip (33). The user then holds the handle so as to keep the lines (17) taught and moves the handle in an upwards direction. As the cleat unit (31) is placed near the top of the strap (5), as for example shown in FIG. 14, this causes the lines (17) inside the cleat unit (31) to move from the locked position into the unlocked position.

The user can then, by moving the handle towards the cleat unit (31), move the luggage pack (1) towards the extended position. In the fully extended position, the handle will rest against the cleat unit, thereby preventing the luggage pack from being extended any further. Alternatively, the user locks the luggage pack into position by moving the handle (35) downwards. This moves the lines (17) into the second configuration of the cleat unit (31), which causes the cleat unit to frictionally retain the lines.

Whilst in the extended position, the user can reach behind to either side at waist level, and pull the luggage pack round to his or her front to access the contents, or to place it on the lap whilst sitting.

If the user wishes to lock the luggage pack (1) into a partially extended position, the user moves the handle (35) substantially downwards when the luggage pack is in the desired position, thereby moving the lines (17) into the locked position in the cleat unit (31).

The above embodiments are described by way of example only. Many variations of the above embodiment is possible without departing from the scope of the invention. For example, although 3 and 5 lines are disclosed in the first and second embodiments respectively, this number could be four, or in principle another number. Although a locking unit is shown, this may be unnecessary in some cases (e.g. for small loads). Although nylon cord lines are discussed, other materials having sufficiently low friction and high strength may be used, as may other flexible strong members such as straps.

Although the handle is shown on one side (the user's left side), in another embodiment the handle, locking unit and clip (which together or individually form an actuating means) may be removable and repositionable to the other side (for example, retained with Velcro™). It is possible to provide the lines and/or the anchors with releasable fastenings, allowing the removal and interchange of luggage packs.

The invention claimed is:

1. A backpack, comprising:

a back portion, the back portion comprising a carrying means for enabling the back portion to be carried on a back of a user;

a load carrying portion;

an actuating means to be manipulated by the user;

a plurality of elongate flexible members connected to the load carrying portion and operable to:

lower the load carrying portion from a retracted upper position, in which the load carrying portion is secured against the back portion, to an extended lower position, in which the load carrying portion is movably suspended from the back portion by way of the actuating means; and elevate the load carrying portion from the extended lower position to the retracted upper position, by way of the actuating means; and a locking means, on the back portion, operable to releasably retain the load carrying portion in either of the retracted or extended positions;

wherein the elongated flexible members are guided over the shoulder of the user to the actuating means; and wherein, when the load carrying portion is in the extended lower position, the user can reach behind and pull the load carrying portion round to a front of the user, while the back portion remains on the back of the user.

2. A backpack according to claim 1, wherein at least one of the elongate flexible members is provided with a guide element, the guide element being operable to prevent relative movement between the elongate flexible member and the carrying means when the load carrying portion is in the retracted position.

3. A backpack according to claim 1, wherein each of the elongate flexible members has a length selected so as to maintain spatial orientation of the load carrying portion during movement of the load carrying portion between the extended and retracted positions, so that the load carrying portion has the same spatial orientation in the extended position as in the retracted position.

4. A backpack according to claim 1, wherein the carrying means comprises two shoulder straps.

5. A backpack according to claim 1, wherein the plurality of elongate flexible members are operable to:

lower the load carrying portion from the retracted upper position to the extended lower position when the actuating means is moved from a first position to a second position; and elevate the load carrying portion from the extended lower position to the retracted upper position when the actuating means is moved from the second position to the first position.

6. A backpack according to claim 5, further comprising a resilient sheath element which encloses at least one of the elongate flexible members substantially along the entirety of its length.

7. A backpack according to claim 6, wherein the resilient sheath element has a length such that the sheath element is in a partially extended configuration when the actuating means is in the first position.

8. A backpack according to claim 1, wherein the back portion further comprises a back plate.

9. A backpack according to claim 8, wherein the back plate is formed so as to substantially conform to the back of the user.

10. A backpack according to claim 8, further comprising at least one tubular element for guiding at least one of the plurality of elongate flexible members, wherein the at least one tubular element is attached to a surface of the back plate and has a radius of curvature.

11. A backpack according to claim 10, wherein the at least one tubular element is positioned in a respective at least one groove in the surface of the back plate.

12. A backpack according to claim 10, wherein each of the at least one tubular elements has a lower aperture positioned in a configuration which is symmetrical around the vertical central axis of the back portion.

13. A backpack according to claim 12, wherein the load carrying portion comprises a plurality of anchors on a surface thereof, in the same number as the plurality of elongate flexible members, and wherein each elongate member is attached to one of said anchors.

14. A backpack according to claim 13, wherein the configuration of anchors on the surface of the load carrying portion is aligned with the configuration of lower apertures of the at least one tubular element on the back portion so that each of the plurality of elongate flexible members can pass from an anchor to a lower aperture, allowing the load carrying portion to be aligned with the back portion at a plurality of points.

15. A backpack according to claim 1, wherein the locking means comprises frictional retention means.

16. A backpack according to claim 15, wherein the locking means comprises a resiliently biased cam, the cam being operable to move between a retaining position, in which at least one of the elongate flexible members is frictionally retained, and an open position.

17. A backpack according to claim 16, wherein the locking means comprises a release means for moving the resiliently biased cam from the retaining position to the open position.

18. A backpack according to claim 17, wherein the release means is actuated by an actuator, the actuator being located remotely from the release means.

* * * * *